US005207146A

United States Patent [19]

Fortmann et al.

[11] Patent Number: 5,207,146

[45] Date of Patent: May 4, 1993

[54] WORKING CYLINDER WITHOUT PISTON ROD

[75] Inventors: Norbert Fortmann, Hanover; Helmut Göttling, Isernhagen; Rudolf Möller, Gehrden; Gerhard Scharnowski, Gehrden; Hans F. Meyer, Gehrden, all of Fed. Rep. of Germany

[73] Assignee: Mannesmann Aktiengesellschaft, Dusseldorf, Fed. Rep. of Germany

[21] Appl. No.: 809,674

[22] Filed: Dec. 18, 1991

Related U.S. Application Data

[63] Continuation-in-part of Ser. No. 703,921, May 22, 1991, Pat. No. 5,117,740.

[30] Foreign Application Priority Data

May 23, 1990 [DE] Fed. Rep. of Germany ..... 4016567
Dec. 20, 1990 [DE] Fed. Rep. of Germany ..... 4041368

[51] Int. Cl.[5] ..... F01B 29/00

[52] U.S. Cl. ..... 92/88; 92/137; 403/106; 403/364

[58] Field of Search ..... 92/88, 137; 403/106, 403/364, 393

[56] References Cited

U.S. PATENT DOCUMENTS 4,694,733 9/1987 Green ..... 92/88

FOREIGN PATENT DOCUMENTS

WO80/02184 10/1980 Sweden ..... 403/364

*Primary Examiner*—Edward K. Look
*Assistant Examiner*—F. Daniel Lopez
*Attorney, Agent, or Firm*—Cohen, Pontani, Lieberman, Pavane

[57] ABSTRACT

A working cylinder which operates without a piston rod, comprising a cylinder tube, a piston which is displaceable therein and is provided with a pulling means, and a force transmission element which is connected with the pulling means and guided in axial displacement on the cylinder tube. In order to minimize the mounting work for the external attachment of the pulling means and at the same time increase the dependability of operation, the pulling means (1) is provided on the ends thereof connected to the force transmission element (2) with clamping pieces (3) which are provided with a toothed surface (5) on at least one outer side (4) and the force transmission element (2) is provided with a correspondingly toothed surface (6) against which the side (4) of the corresponding clamping piece (3) having the toothed surface (5) can be pressed via a pressing element (7). The corresponding toothed surface of the force transmission element (2) is longer than the clamping pieces (3) to allow for adjustment. The pressing element (7) and the force transmission element (2) together form an integral structure.

4 Claims, 1 Drawing Sheet

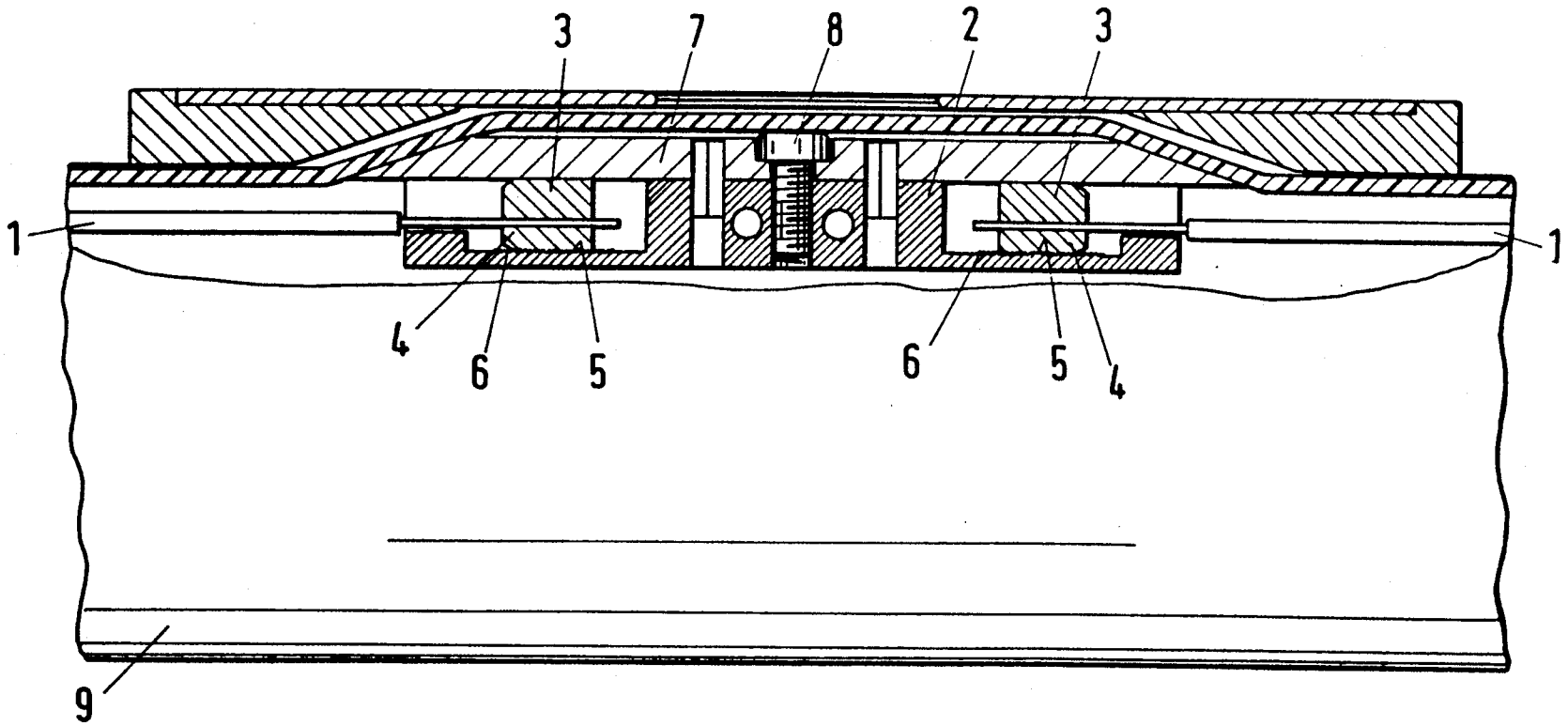
1
3
2
8
7
3
1
4
5
6
5
6
4
9

WORKING CYLINDER WITHOUT PISTON ROD

RELATED APPLICATIONS

This application is a continuation-in-part of U.S. patent application Ser. No. 07/703,921, filed May 22, 1991, (now U.S. Pat. No. 5,117,740), which claims priority from German Patent Application No. 40 16 567.1, filed May 23, 1990. The disclosure of Ser. No. 07/703,921 is not incorporated herein by reference.

FIELD OF THE PRESENT INVENTION

The present invention relates to a working cylinder which operates without a piston rod, consisting of a cylinder and a piston which is displaceable within the cylinder which is provided with a tensile force source connected to a flexible tensile force transmission means, which is guided on the cylinder tube.

BACKGROUND OF THE PRESENT INVENTION

A working cylinder operating without a piston rod of the type described is known from German Utility Model DE 76 08 315. In that case, a rope serves as a pulling means, or flexible tensile force transmitting means. The rope is guided from the inside of the cylinder to the outside of the cylinder in a sealed manner, from the ends of the cylindrical tube. The seals are arranged in the region of the cylinder covers or endcaps. The free ends of the rope are guided parallel to the cylindrical tube via guide rollers, present in the region of the cylinder covers, and the ends of the rope are connected to a further force transmission element which is formed as an attachment yoke. The connection between the ends of the rope and the attachment yoke is made in DE 76 08 315 by providing the free ends of the rope with head sleeves, which are introduced into threaded bushings. Clamping nuts are used for effecting the tensioning of the entire rope. Additional securing bushings strengthen and secure this attachment.

The arrangement of DE 76 08 315 has the disadvantage that a large amount of time is required for the mounting of such a working cylinder. In the operation of this known working cylinder, the attachment yoke is either formed integrally as a force transmission element or can be connected with such an element. The force of the movement of a piston in the cylinder, which is conducted outwards via the rope, is then tapped off via the provided force transmission element. This furthermore has the disadvantage that threaded elements within the region of attachment between the rope and the force transmission element or attachment element can loosen, and must then be checked from time to time and readjusted. Furthermore, the tensioning of the pulling means is adjustable only within a small range.

OBJECTS OF THE PRESENT INVENTION

It is therefore an object of the present invention to provide a working cylinder which functions without a piston rod in which the installation expense for the external attachment of the pulling means is minimized and the dependability in operation increased.

It is another object of the present invention to provide a working cylinder which operates without a piston rod which has, at the ends of the pulling means which are connected to the force transmission element, clamping pieces which are provided with a toothed surface on at least one outer side, and that the force transmission element is provided with a correspondingly toothed surface against which the side of the corresponding clamping piece having the toothed surface can be pressed, by means of a pressing element.

It is a further object of the present invention to provide an actuator cylinder operating without a piston rod, comprising a cylinder tube having a longitudinal axis, a piston, axially displaceable in said cylinder tube, a force transmitting element, which is guided axially along an axis generally parallel to said cylinder tube, having a toothed surface, a pulling means for transmitting a force associated with a movement of said piston in said cylinder to a force transmission means, comprising a flexible tensile force transmitting element, said pulling means having two ends, two clamping pieces, each having a toothed surface corresponding to said toothed surface of said force transmitting element and means for clamping said ends of said pulling means, and a pressing means for pressing said toothed surface of said force transmission element against said corresponding toothed surface of said clamping pieces, so that there is no relative movement therebetween.

It is another object of the present invention to provide an actuator cylinder wherein said pressing element is integral with said force transmission element.

It is another object of the present invention to provide an actuator cylinder wherein said toothed surface of said force transmission element has a greater axial length than an axial length of at least one of said clamping pieces.

SUMMARY OF THE PRESENT INVENTION

The present invention provides a working cylinder or actuator cylinder which operates without a piston rod, having provided at the ends of the pulling means, which are connected to the force transmission element, clamping pieces which are provided with a toothed surface on at least one outer side thereof. The force transmission element is provided with correspondingly toothed surface, against which the side of the corresponding clamping piece having the toothed surface can be pressed by means of a pressing element.

The fact that, in each case, at least one of the outer sides of the clamping pieces are provided with a toothed surface and that the toothed outer side of these clamping pieces can be pressed, via a pressing element, against a correspondingly toothed surface, which is provided in association with the force transmission element, assures a dependable and reliable attachment of the ends of the pulling means, which is a belt or rope, to the force transmission element. Furthermore, the pulling means may be rapidly mounted to the force transmission element. The fact that the toothing of the corresponding clamping piece engages into the toothing of the force transmission element, and that the pressing element provides this pressing action assures, due to the formlock (having a mechanical interference fit) and frictional lock (being held in relation by the force applied and the friction of the surfaces) thus produced, a dependable working cylinder according to the present invention. The pressing element is integrated in the force transmission element, so that a simple structural form is thereby developed.

According to a further advantage of the present invention, the corresponding toothed surface on the force transmission element is of greater axial length than the axial length of the clamping piece, resulting in the advantage that the clamping pieces are axially displaceable during the mounting operation, prior to engagement of the pressing element, and thus provides for adjustability of the pulling means with respect, for instance, to its tension. Furthermore, equalization and adjustment of the tolerances is facilitated thereby.

BRIEF DESCRIPTION OF THE DRAWING

The invention will be described in greater detail below with respect to the figure in the drawing, in which:

The sole FIGURE shows, in cross sectional view, a part of a cylinder of the present invention.

DETAILED DESCRIPTION OF THE PREFERRED EMBODIMENT

The sole figure shows a cross sectional view of a working cylinder or actuator cylinder which operates without a piston rod, according to the present invention. Parallel to the cylindrical tube 9, the force transmission element 2 is displaceable along an outer side thereof. In this connection, the force transmission element 2 is displaceably guided in a guide. The ends of the pulling means 1, which acts as a flexible tensile force transmitting means, which are shown in the installed condition, pressed together in each case with one of the clamping pieces 3, so as to assure a dependable fixation of the pulling means 1, to the force transmission element 2. The pulling means 1 is a pull belt, which is clamped within the clamping pieces 3. The clamping pieces 3 may clamp the pulling means 1 by a frictional fit or by a mechanical fit, or both. If, for example, the pulling means 1 is developed as a toothed belt, then the clamping pieces 3 could have a corresponding mating toothed surface, which would provide a mechanical fit. On the other hand, the clamping means could also be developed with a smooth or roughened surface for pressing against a rope or belt, comprising the pulling means 1, to provide a frictional fit.

The outer surface 4 of the clamping piece 3 is provided with the toothed surface 5, which engages the correspondingly toothed surface 6 of the force transmission element 2. The axial length of the toothed surface 6 of the force transmission element 2 is greater than the axial dimension of the clamping piece 3, so that the clamping piece 3 is axially displaceable along the toothed surface 6 within the force transmission element 2, as long as the pressing element 7, developed here as a plate, is still detached or not engaged. When the optimal tension of the pulling means 1 is reached or obtained, the pressing element 7, which is a plate, is pressed, by tightening screws 8, against the clamping piece 3. The toothed surface 5 of the clamping piece and the toothed surface 6 of the force transmission element 2 become engaged in form-locked manner to one another, thus providing a mechanical interference fit which prevents relative movement therebetween. This structure permits a rapid mounting and furthermore assures dependable operation of the working cylinder.

The pressing element 7 is integral to the force transmitting function, along with the force transmitting element 2. Thus, the screws 8 serve not only to apply a force to said clamping means 3, but also to fix the pressing element 7 and the force transmission element 2 in relation to one another so that they become an integral structure.

It should be understood that the preferred embodiment described is for illustrative purposes only and is not to be construed as limiting the scope of the present invention, which is properly delineated only in the appended claims.

What is claimed is:

1. An actuator cylinder operating without a piston rod, comprising:

a cylinder tube having a longitudinal axis;

a piston, axially displaceable in said cylinder tube;

a force transmitting element, which is guided axially along an axis generally parallel to said cylinder tube, having a toothed surface;

a pulling means for transmitting a force associated with a movement of said piston in said cylinder to a force transmission means, comprising a flexible tensile force transmitting element, said pulling means having an end;

a clamping piece, having a toothed surface corresponding to said toothed surface of said force transmitting element, said end of said pulling means being attached to said clamping piece; and a pressing means for pressing said toothed surface of said force transmission element against said corresponding toothed surface of said clamping piece, so that there is no relative movement therebetween:

wherein said toothed surface of said force transmission element has a greater axial length than an axial length of said clamping piece.

2. The actuator cylinder according to claim 1, wherein said pressing element is integral with said force transmission element.

3. An actuator cylinder operating without a piston rod, comprising:

a cylinder tube having a longitudinal axis;

a piston, axially displaceable in said cylinder tube;

a force transmitting element, which is guided axially along an axis generally parallel to said cylinder tube, having two toothed surfaces;

a pulling means for transmitting a force associated with a movement of said piston in said cylinder to a force transmission means, comprising a flexible tensile force transmitting element, said pulling means having first and second ends;

first and second clamping pieces, each having a toothed surface corresponding to one of said toothed surfaces of said force transmitting element, said first end of said pulling means being attached to said first clamping piece and said second end of said pulling means being attached to said second clamping means; and a pressing means for pressing said toothed surfaces of said force transmission element against said corresponding toothed surfaces of said clamping pieces, so that there is no relative movement therebetween:

wherein each toothed surface of said force transmission element has a greater axial length than an axial length of each of said clamping pieces.

4. The actuator cylinder according to claim 3, wherein said pressing element is integral with said force transmission element.

* * * * *